US009560728B2

(12) United States Patent
Parello et al.

(10) Patent No.: US 9,560,728 B2
(45) Date of Patent: Jan. 31, 2017

(54) NETWORKED LIGHTING MANAGEMENT

(71) Applicant: Cisco Technology, Inc., San Jose, CA (US)

(72) Inventors: John D. Parello, Campbell, CA (US); Jason Potterf, Austin, TX (US); Xiaohang Li, Cupertino, CA (US)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 15/050,672

(22) Filed: Feb. 23, 2016

(65) Prior Publication Data

US 2016/0174347 A1 Jun. 16, 2016

Related U.S. Application Data

(63) Continuation of application No. 14/563,396, filed on Dec. 8, 2014, now Pat. No. 9,307,621.

(51) Int. Cl.
*H05B 37/02* (2006.01)
*H05B 33/08* (2006.01)

(52) U.S. Cl.
CPC ..... *H05B 37/0272* (2013.01); *H05B 33/0845* (2013.01)

(58) Field of Classification Search
CPC ... H05B 33/0845; H05B 37/02; H05B 37/029; H05B 37/0245; H05B 37/0272; Y02B 20/48
USPC ..... 315/312, 318, 292, 307, 297, 294
See application file for complete search history.

(56) References Cited

U.S. PATENT DOCUMENTS

| | | | | |
|---|---|---|---|---|
| 7,880,405 | B2 | 2/2011 | Chitta et al. | |
| 8,035,320 | B2 | 10/2011 | Sibert | |
| 8,352,769 | B1 | 1/2013 | Ghose et al. | |
| 8,519,566 | B2 | 8/2013 | Recker et al. | |
| 8,732,501 | B1 | 5/2014 | Ghose et al. | |
| 8,745,429 | B2 | 6/2014 | Ghose et al. | |
| 8,938,468 | B2 | 1/2015 | Morgan et al. | |
| 9,018,858 | B2 | 4/2015 | Gambeski et al. | |
| 9,137,878 | B2 | 9/2015 | Thompson | |
| 9,307,621 | B1 * | 4/2016 | Parello | H05B 33/0845 |
| 2014/0354187 | A1 | 12/2014 | Aggarwal et al. | |

* cited by examiner

*Primary Examiner* — Haissa Philogene
(74) *Attorney, Agent, or Firm* — Edell, Shapiro & Finnan, LLC

(57) ABSTRACT

Techniques presented herein are directed to lighting management techniques supporting lighting functions of networked light fixtures. In accordance with one example, a light fixture in networked lighting system accepts a lighting request transmitted by a computing device. The light fixture determines whether the lighting request is a control message or a query message and performs one or more operations in response to the lighting request depending on whether the lighting request is a control message or a query message.

20 Claims, 7 Drawing Sheets

ACCESS CONTROL LIST 240

242 244

| USER | CONTROLLABLE ATTRIBUTES |
|---|---|
| USER A | - EMITTED COLOR<br>- LIGHT FIXTURE STATUS |
| USER B | LEVEL 1<br>(ALL ATTRIBUTES) |
| USER C | LEVEL 5<br>(LIGHT FIXTURE STATUS ONLY) |

FIG.3

NETWORKED LIGHTING MANAGEMENT

CROSS-REFERENCE TO RELATED APPLICATIONS

This application is a continuation of U.S. application Ser. No. 14/563,396, filed Dec. 8, 2014, the entirety of which is incorporated herein by reference.

TECHNICAL FIELD

The present disclosure relates to the management of networked light fixtures.

BACKGROUND

Commercial buildings, highways, parks, and other spaces are increasingly being fit with energy efficient light fixtures (e.g., light emitting diode (LED)-based light fixtures). With light fixtures powered and controlled via a communication network, it is possible to provide building tenants, maintenance workers, and even visitors control over the light emitted in their space.

BRIEF DESCRIPTION OF THE DRAWINGS

FIG. 3 is a schematic diagram illustrating an access control list in accordance with embodiments presented herein.

DESCRIPTION OF EXAMPLE EMBODIMENTS

Overview

Techniques presented herein are directed to lighting management techniques for lighting functions of networked light fixtures. In accordance with one example, a light fixture in networked lighting system accepts a lighting request transmitted by a computing device. The light fixture determines whether the lighting request is a control message or a query message and performs one or more operations in response to the lighting request depending on whether the lighting request is a control message or a query message.

Example Embodiments

Figure 1:
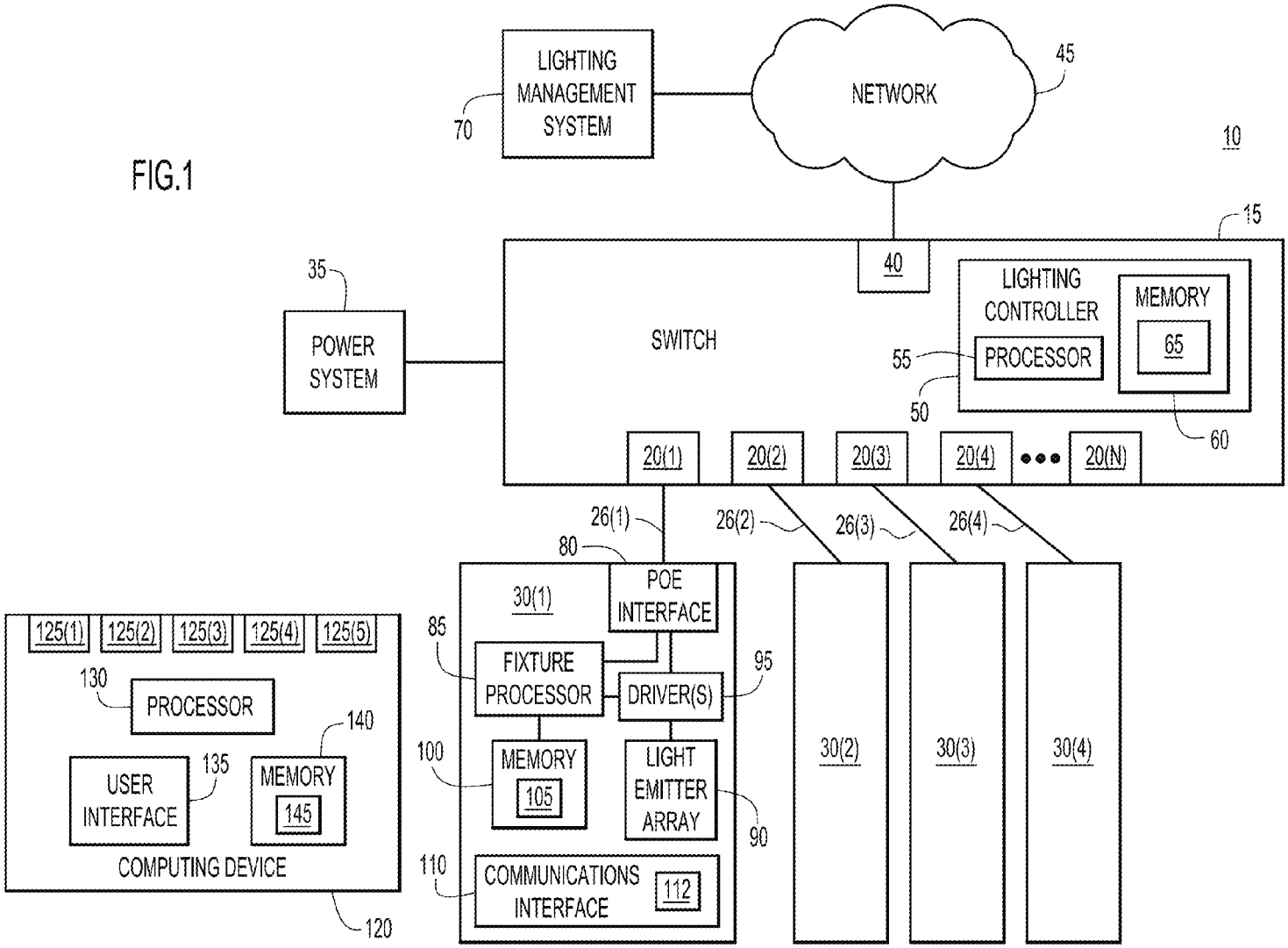
FIG. 1 is a block diagram of a networked lighting system in which the lighting management techniques in accordance with embodiments presented herein may be implemented.

FIG. 1 is a block diagram of a networked lighting system 10 deployed in a space, such as a commercial building, park, entertainment venue, etc., and configured to implement lighting management techniques presented herein. Merely for ease of description, the lighting management techniques presented herein are described with reference to the networked lighting system 10 deployed in a commercial building. However, it to be appreciated that the lighting management techniques may be employed in different spaces.

As shown in FIG. 1, networked lighting system 10 comprises a network device 15, such as a switch, that includes a plurality of ports 20(1)-20(N). The switch 15 may be a Power-over-Ethernet (PoE) switch that uses PoE to provide both power and data to downstream devices. As such, the ports 20(1)-20(N) are sometimes referred to herein as PoE ports 20(1)-20(N). While a PoE switch 15 is used in this example, the techniques presented herein are not limited to use with PoE. Instead, switch 15 may also use any other communication mechanism that provides both power and data to a downstream device using the same underlying transport (e.g., Ethernet). Other such communication mechanisms include, for example, PoE Plus (PoE+), Universal PoE (UPOE), high power Universal Serial Bus (USB), etc.

In the specific example of FIG. 1, the switch 15 receives power from a reliable power system 35. The reliable power system 35 may, for example, primarily receive power from a utility grid and include a back-up power mechanism (e.g., generators). The switch 15 also comprises one or more network interface units 40 that enable communication over at least one network 45 (e.g., one or more Local Area Networks (LANs), Wide Area Networks (WANs), etc.). A lighting management system 70 communicates with the switch 15, as well as other switches (not shown in FIG. 1) using the network 45.

The lighting management system 70 manages switch 15 and all other switches (not shown) in the networked lighting system 10. The lighting management system 70 includes the processing, networking and storage elements that are necessary to support the lighting management and, in general, may only be accessible to the building management team.

Also included in switch 15 is a lighting controller 50 that assists in the management of attached light fixtures. Lighting controller 50 comprises a processor 55 and a memory 60 that includes control logic 65. Memory 60 may comprise read only memory (ROM), random access memory (RAM), magnetic disk storage media devices, optical storage media devices, flash memory devices, electrical, optical, or other physical/tangible memory storage devices. The processor 55 is, for example, a microprocessor or microcontroller that executes instructions for the control logic 65. Thus, in general, the memory 60 may comprise one or more tangible (non-transitory) computer readable storage media (e.g., a memory device) encoded with software comprising computer executable instructions and when the software is executed (by the processor 55) it is operable to perform lighting management operations described herein.

A subset of the PoE ports 20(1)-20(N) are connected, via respective Ethernet cables 26(1)-26(N), to one or more networked light fixtures. In the example of FIG. 1, four (4) networked light fixtures 30(1)-30(4) are shown each connected to one of the ports, namely ports 20(1), 20(2), 20(3), and 20(4), respectively. As such, the light fixtures 30(1)-30(4) obtain power from the switch 15 and may also be commanded to perform operations by the switch 15. It is to be appreciated that the specific number and arrangement of networked light fixtures shown in FIG. 1 is merely illustrative and that other topologies or network types could be used. For ease of illustration, the details of only a single networked light fixture 30(1) are shown in FIG. 1. Each of the networked light fixtures 30(2)-30(4) have a substantially similar configuration as that of networked light fixture 30(1).

Networked light fixture 30(1) includes a PoE interface 80, a fixture processor 85, an array 90 of light emitters, light emitter driver(s) 95, a memory 100, and a communications interface 110. Memory 100 comprises light fixture logic 105. The light emitter array 90 includes a plurality of light emitters, such as light emitting diodes (LEDs). The memory 100 may comprise ROM, RAM, magnetic disk storage media devices, optical storage media devices, flash memory devices, electrical, optical, or other physical/tangible memory storage devices. The fixture processor 85 is, for example, a microprocessor or microcontroller that executes instructions for the light fixture logic 105. Thus, in general, the memory 100 may include one or more tangible (non-transitory) computer readable storage media (e.g., a memory device) encoded with software comprising computer executable instructions for the light fixture logic 105, and when the software is executed (by the fixture processor 85) it is operable to perform lighting management operations described herein.

Communications interface 110 is a collection of elements that enable communication with one or more computing devices. The communications interface 110 may comprise, for example, a Wi-Fi interface, 3G interface, Bluetooth interface, a visible light communication (VLC) or Li-Fi interface, network interface port, etc. Li-Fi is a mechanism that uses visual light from light emitters, such as LEDs, as a medium for wireless communication. Li-Fi operates by flashing the light emitters (i.e., rapidly switching light emitters in a transmitting device on and off) in a coded manner. The flashes of light, which represent data, are detected at one or more photodiodes in a receiving device. As such, in examples in which the communications interface 110 operates as a Li-Fi interface, the communications interface 110 includes one or more photodiodes 112. If enabled for the transmission of data, the communications interface 110 may include light emitters or, alternatively, one or more of the emitters within light emitter array 90 may be used for Li-Fi communications.

FIG. 1 illustrates a general arrangement for a networked light fixture in accordance with examples presented herein. It is to be appreciated that a networked light fixture may include other components that are not shown in FIG. 1. For example, other networked light fixtures in accordance with examples presented herein may include sensors (e.g., to measure temperature, an actual light level emitted by light emitter array, etc.), power control circuits, an on-board battery, a battery controller/charger, etc. Additionally, the networked light fixtures may have a number of different structural forms such as, for example, ceiling troffers, pendants, valances, strips, task lights, lighting integrated into furniture or cabinets, desk lamps, floor lamps, streetlights, high-bay lighting, etc. It is also to be appreciated that the networked light fixture 30(1)-30(4) may have other configurations.

As noted, the communications interface 110 is configured to receive signals from, and possibly transmit signals to, one or more computing devices. FIG. 1 illustrates details of an example computing device 120 configured to communicate with a light fixture, such as light fixture 30(1) via the communications interface 110. Computing device 120 may be, for example, a computer (desktop, laptop, etc.,), a mobile device (phone, tablet, etc.), or other device enabled with the capability to establish a wireless communication session with a light fixture.

As shown, computing device 120 comprises four different types of wireless interfaces, including Wi-Fi interface 125 (1), 3G interface 125(2), Bluetooth interface 125(3), a VLC or Li-Fi interface 125(4), and/or a Near Field Communication (NFC) interface 125(5). Each of these interfaces may be used to communicate with light fixture 30(1), depending on the configuration of communications interface 110 of the light fixture. As noted above, a Li-Fi interface, such as Li-Fi interface 125(4), includes one or more light emitters that are switched on/off to transmit data to one or more photodiodes (e.g., photodiodes 112 in light fixture 30(1)). If Li-Fi interface 125(4) is enabled to receive data, then Li-Fi interface 125(4) includes or operates with one or more photodiodes to receive visual light from a transmitter in, for example, light fixture 30(1). Computing device 120 may also a network interface port (not shown) for a hardwire connection with a network interface port of the communications interface 110. NFC allows two devices placed within close proximity (e.g., a few centimeters) of each other to exchange data. As such, NFC could be useful to enable computing device 120 to communicate with lights by, for example, tapping the phone to a table lamp or other element.

Computing device 120 further comprises a processor 130, a user interface 135, and a memory 140. Memory 140 comprises wireless lighting control logic 145. User interface 135 may take many different forms and may include, for example, a keypad, keyboard, mouse, touchscreen, display screen, etc.

Memory 140 may comprise ROM, RAM, magnetic disk storage media devices, optical storage media devices, flash memory devices, electrical, optical, or other physical/tangible memory storage devices. The processor 130 is, for example, a microprocessor or microcontroller that executes instructions for the wireless lighting control logic 145. Thus, in general, the memory 140 may comprise one or more tangible computer readable storage media (e.g., a memory device) encoded with software comprising computer executable instructions and when the software is executed (by the processor 130) it is operable to manage aspects of networked lighting system 10 through a connection, such as a wireless connection, with a light fixture.

It is also to be appreciated that FIG. 1 illustrates software implementations of light fixture logic 105 (light fixture 30(1)), control logic 65 (switch 15), and wireless lighting control logic 145 (computing device 120). It is to be appreciated that these software implementations are merely illustrative and that other implementations are possible. For example, in an alternative arrangement, light fixture logic 105, control logic 65, and/or wireless lighting control logic 145 may be implemented fully or partially as hardware elements, such as digital logic gates in one or more application-specific integrated circuits (ASICS).

The lighting management techniques presented herein support intelligent network control of lighting functions in a space by providing active control loops for the settings of individual light fixtures, improving energy efficiency, etc. The lighting management techniques also enforce building management codes, such as exit and emergency lighting, minimum light illumination levels, etc., allow dynamic lighting policies that change, for example, upon time and season, provide conflict resolution between different lighting requests from multiple users, enable lighting access control, and provide users with the ability to control light fixtures through wireless communication with a light fixture. These and other features of the lighting management techniques are described in greater detail below with reference to the arrangement of FIG. 1.

In accordance with certain examples, the lighting management techniques support a robust lighting request mechanism that enables a user to query (i.e., determine) or control (i.e., set) various lighting attributes of a light fixture. As used herein, lighting attributes refer to the various controllable/adjustable settings of a light fixture, such as light emitter status (e.g., on/off), emitted colors (e.g., white, red, green, blue or combinations thereof), emitted white light temperature, power settings, etc. For example, the lighting request mechanism may be used on lighting illumination to query or control the illumination level of the lighting. The lighting request mechanism could also be used to query or control the color of the lighting, query or control the lighting power use, and/or query or control whether lighting recurrence should be supported.

The lighting management techniques support the input of the location of the light when, for example, a light fixture is installed. The lighting management techniques may be subsequently used to query the location of the light fixture. Additionally, each light fixture 30(1)-30(4) may have a unique identifier (ID). The ID of the lighting can be used in many applications, such as localization. The lighting management techniques presented herein may be used to set or query the light fixture ID.

In certain examples, lighting management system 70 and or switch 15 could initiate lighting requests to the light fixtures 30(1)-30(4). In other examples, the lighting requests may be initiated by computing device 120 through a connection between the computing device and a light fixture. For example, computing device 120 could wirelessly connect to the networked lighting system 10 via a light fixture using, for example, Wi-Fi, Li-Fi, etc. and could send lighting requests for query or control of a local or remote light fixture. As used herein, a "local" light fixture refers to a light fixture that communicates directly with a computing device. A "remote" light fixture refers to a light fixture that is connected to a computing device via (though) another light fixture and part of the networked lighting system. FIGS. 2A-2D are schematic diagrams illustrating various lighting requests initiated by computing device 120 through a wireless connection with light fixture 30(1).

Figure 2A:
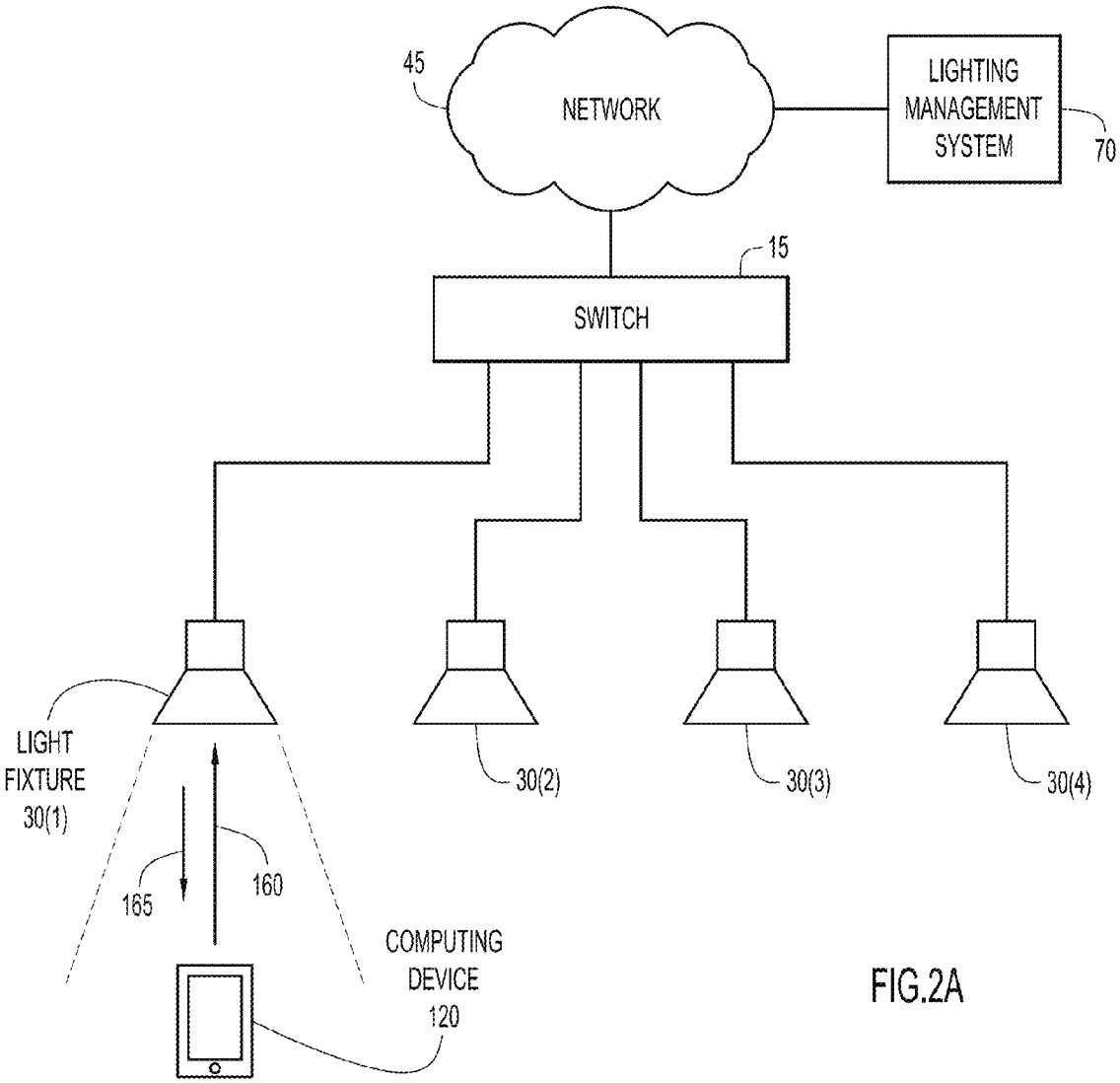
FIGS. 2A-2D are diagrams illustrating aspects of the lighting management techniques in accordance with embodiments presented herein.

In the example of FIG. 2A, computing device 120 (e.g., processor 130 executing wireless lighting control logic 145) wirelessly sends lighting requests directly to the light fixture 30(1) which are processed by the light fixture without support from other components of the networked lighting system 10. More specifically, computing device 120 wirelessly transmits a lighting request 160 directly to light fixture 30(1). If the lighting request 160 is a control message that includes light control setting(s) (i.e., one or more operations to be performed by the light fixture 30(1)), then the light fixture 30(1) takes the appropriate action. In other words, the fixture processor 85 executes the light fixture logic 105 to process the lighting request 160 and implement the light control settings included therein. The light fixture 30(1) may generate and send a response 165 to the computing device 120. In examples in which the lighting request 160 includes a light control setting, the response 165 may be a confirmation of execution of the light control settings.

Alternatively, the lighting request 160 may be a query message (i.e., a request for identification of one or more lighting attribute of the light fixture 30(1)). In such examples, the fixture processor 85 executes the light fixture logic 105 to process the lighting request 160 and send a response 165 back to the computing device 120. In such examples, the response 165 includes the requested lighting attributes.

In one specific use case of the arrangement of FIG. 2A, a user may want control a private light fixture in his/her cubicle. As such, the user may use computing device 120 to send a lighting request to the private light fixture to change a lighting attribute. Since the lighting request to the private light fixture does not affect other users, the lighting request does not need to be overridden by the management team and, accordingly, the private light fixture may implement the light control settings within the received lighting request.

Figure 2B:
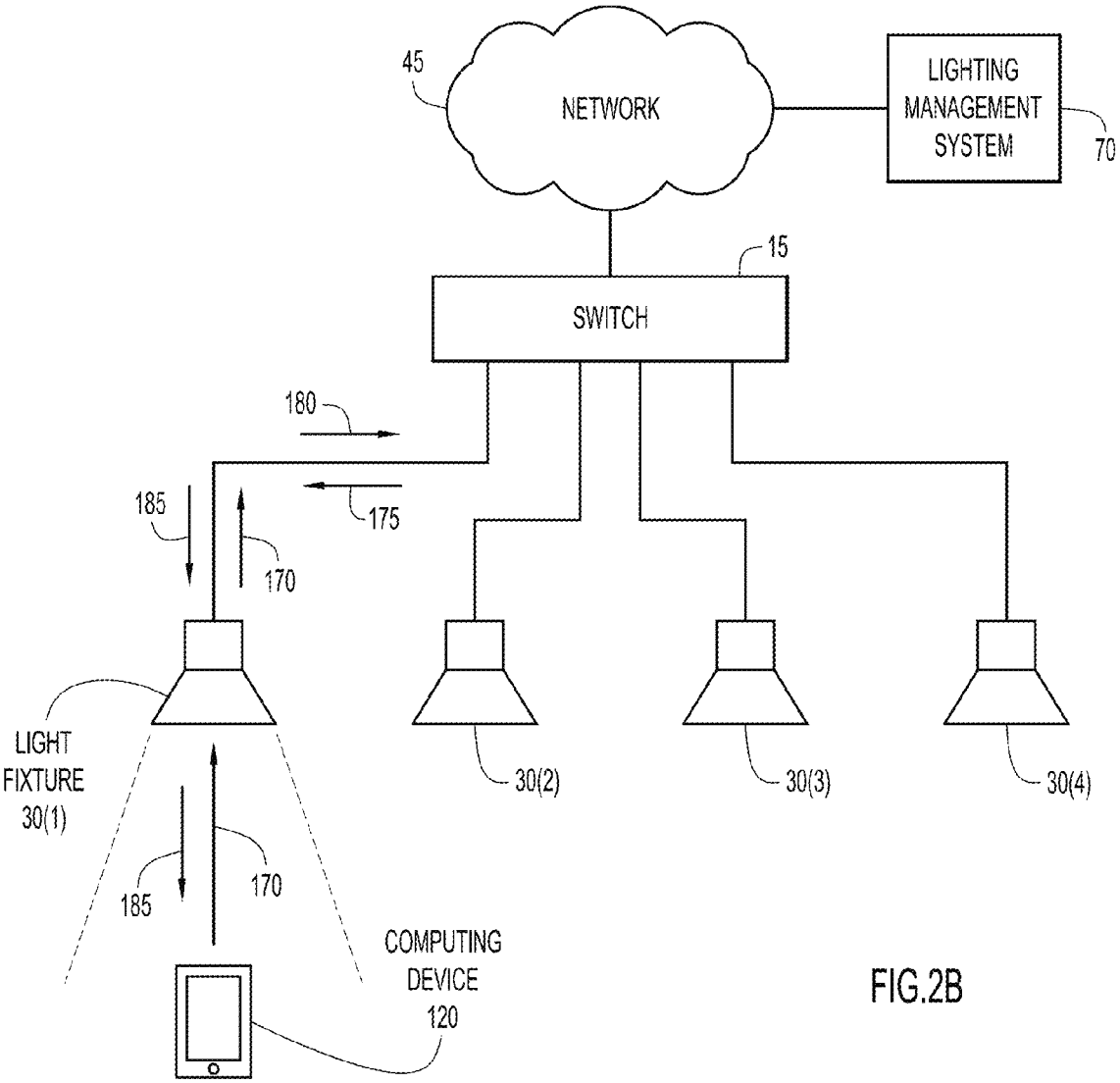

FIG. 2B illustrates an example in which the computing device 120 (e.g., processor 130 executing wireless lighting control logic 145) indirectly controls/queries the light fixture 30(1) via switch 15. More specifically, computing device 120 wirelessly sends a lighting request 170 to light fixture 30(1). The lighting request 170 is transparent to the light fixture 30(1) such that the light fixture 30(1) forwards the lighting request 170 to switch 15. The message sent from light fixture 30(1) to switch 15 may be the same lighting request 170 or a processed/modified version thereof.

If the lighting request 170 is a control message that includes light control setting(s), then the switch 15 identifies the operations to be performed by the light fixture 30(1) and generates a lighting request 175 that encodes the light control settings for execution at light fixture 30(1). In other words, the processor 55 of lighting controller 50 executes the control logic 65 to process the lighting request 170 and generate a message 175 that is sent to the light fixture 30(1) and that causes the light fixture to implement the light control settings included in the lighting request 175. The light fixture 30(1) may generate and send a response 180 to switch 15. The response 180 may be a confirmation of execution of the light control settings. The switch 15 may then generate and send a response 185 that is forwarded to computing device 120 via the light fixture 30(1).

Alternatively, the lighting request 170 may be a query message requesting identification of one or more lighting attributes of the light fixture 30(1). In such examples, the processor 55 of lighting controller 50 executes the control logic 65 to process the lighting request 170 and generate the lighting request 175 that is sent to the light fixture 30(1). In this case, the lighting request 175 acts as a trigger such that, n response, the light fixture 30(1) generates and sends a response 180 back to the switch 15 that includes the requested lighting attributes. The switch 15 may then generate and send a response 185 that includes the requested lighting attributes. The response 185 is forwarded to computing device 120 via the light fixture 30(1). The example of FIG. 2B may be useful, for example, when the processing of packets is executed at the processor of the switch 15, in order to decrease the computing load of the light fixture 30(1).

Figure 2C:
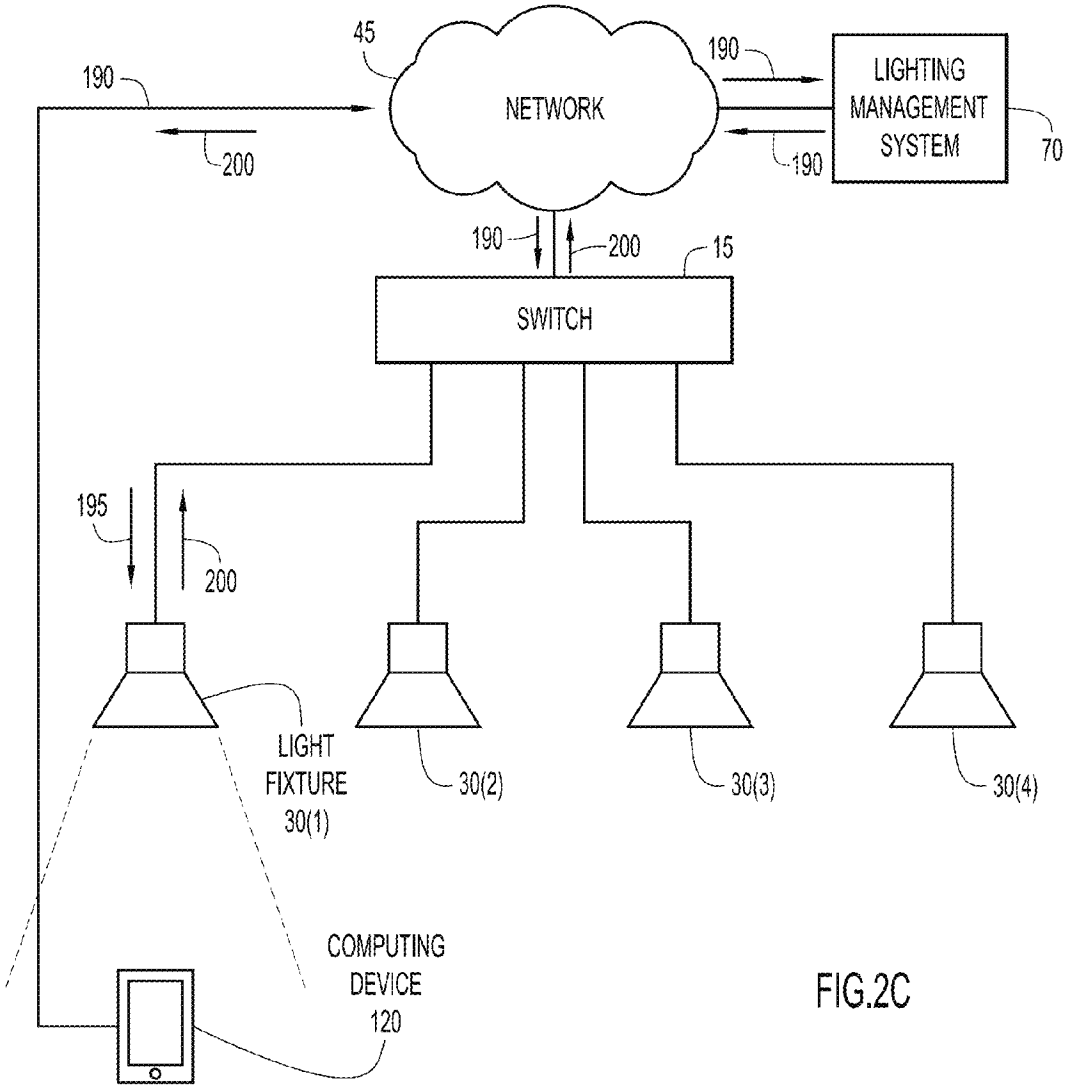

FIG. 2C illustrates an example in which the computing device 120 (e.g., processor 130 executing wireless lighting control logic 145) indirectly controls/queries the light fixture 30(1) via lighting management system 70. More specifically, computing device 120 sends (e.g., wirelessly or through a hardwire network connection) a lighting request 190 to lighting management system 70 through network 45. The lighting management system 70 forwards the lighting request 190 to switch 15. The message sent from lighting management system 70 to switch 15 may be the same lighting request 190 or a processed/modified version thereof.

If the lighting request 190 is a control message that includes light control setting(s), then the switch 15 identifies the operations to be performed by the light fixture 30(1) and generates a lighting request 195 that encodes the light control settings for execution at light fixture 30(1). In other words, the processor 55 of lighting controller 50 executes the control logic 65 to process the lighting request 190 and generate another message 195 that is sent to the light fixture 30(1) and that causes the light fixture to implement the light control settings included in the lighting request 190. The light fixture 30(1) may generate and send a response 200 that is forwarded to the computing device 120 back along the same route (i.e., via switch 15 and the lighting management system 70)). The response 200 may be a confirmation of execution of the light control settings and may be re-generated/modified at each hop.

Alternatively, the lighting request 190 may be a query message requesting identification of one or more lighting attributes of the light fixture 30(1). In such examples, the processor 55 of lighting controller 50 executes the control logic 65 to process the lighting request 190 and generate the lighting request 195 that is sent to the light fixture 30(1). In response, light fixture 30(1) generates and sends the response 200 that includes the requested lighting attributes and which is forwarded to the computing device 120 back along the same route (i.e., via switch 15 and the lighting management system 70)). As noted, the response 200 may be re-generated/modified at each hop.

The example of FIG. 2C may be particularly useful for a building management team to control all light fixtures via the network management system 70. That is, a user who is part of the building management team could use a computing device to issue a lighting request that requests the control of lighting attributes of a number of light fixtures. When the lighting request is received at the network management system 70, the network management system 70 could identify which switch or switches are associated with the number of light fixtures. The network management system 70 could forward the lighting request to those switch or switches that may then generate lighting requests controlling the lighting attributes of the number of light fixtures as set out in the original lighting request.

Figure 2D:
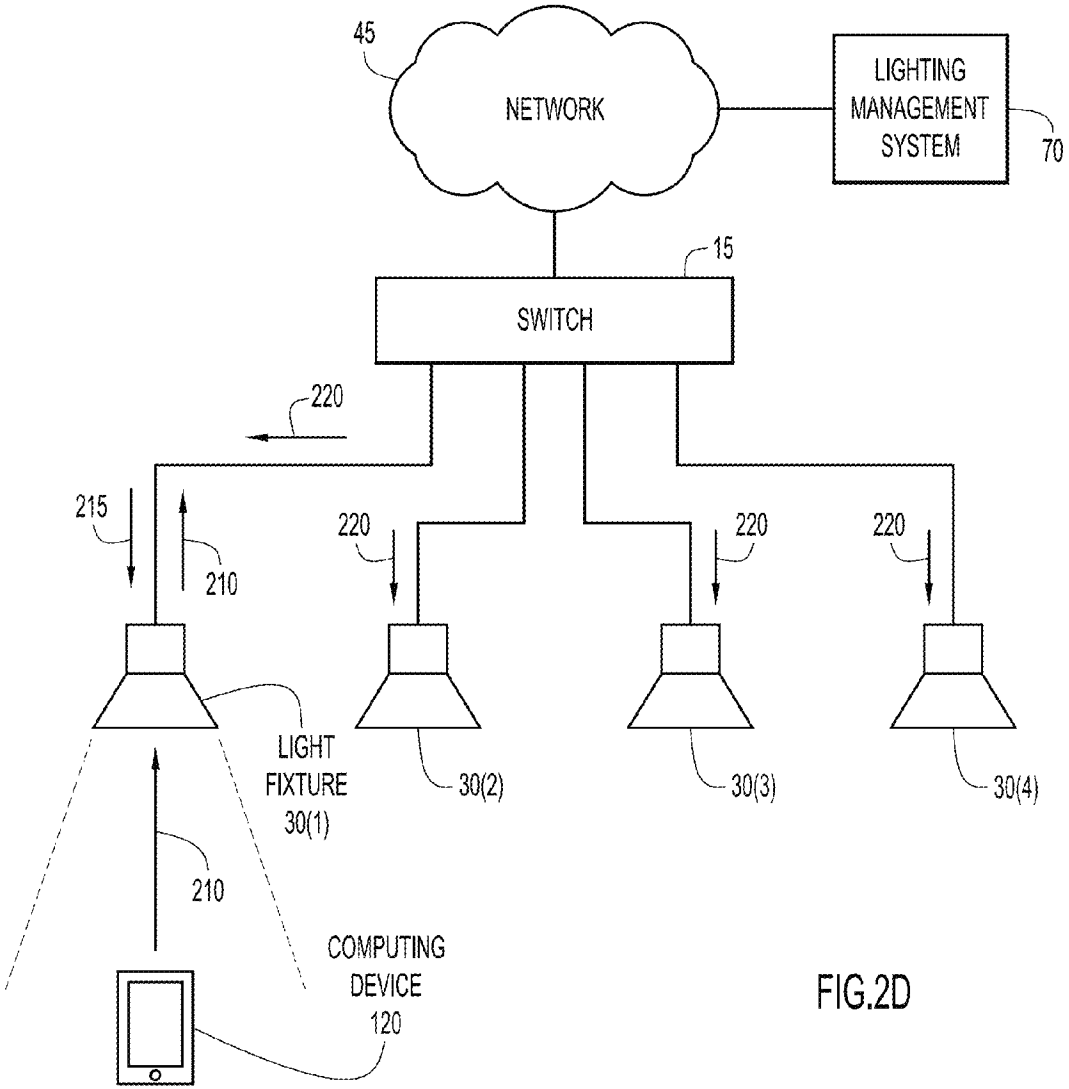

FIG. 2D illustrates an example in which the computing device 120 (e.g., processor 130 executing wireless lighting control logic 145) controls a remote light fixture through a local fixture. More specifically, computing device 120 wirelessly sends a lighting request 210 directly to light fixture 30(1). The light fixture 30(1) forwards the lighting request 210 to switch 15. The message sent from light fixture 30(1) to switch 15 may be the same lighting request 210 or a processed/modified version thereof.

In certain examples, the lighting request 210 is a control message that includes light control setting(s) for one or more of the light fixtures 30(1)-30(4). In this example, the lighting request 210 identifies which light fixtures to control, what lighting attributes to control, etc. The switch 15 authenticates the lighting request 210 and, if the message is accepted, the switch 15 sends an acknowledgment (ACK) message 215 to light fixture 30(1) acknowledging the receipt of the lighting request 210. The acknowledgement message 215 may be forwarded to the computing device 120.

Using the lighting request 210, the switch 15 identifies the involved light fixtures (i.e., the light fixtures that are to perform some operation) and the operations to be performed by each of the involved light fixtures. The switch 15 generates one or more lighting requests 220 that each encodes the light control settings of one or more of the involved light fixtures 30(1). In other words, the processor 55 of lighting controller 50 executes the control logic 65 to process the lighting request 210 and generate one or more lighting requests 220 that are sent to, in this example, light fixtures 30(1)-30(4) to cause the light fixtures to implement the light control settings identified in the lighting request 210.

As noted above, FIG. 2D illustrates an example in which the lighting attributes of a remote light fixture are controlled by a user via a local light fixture. In accordance with further examples, the lighting attributes of a remote light fixture may be obtained by a user via a local light fixture. In such examples, the lighting request 210 may be a query message requesting, for example, one or more lighting attributes of the light fixture 30(4). In such examples, the processor 55 of lighting controller 50 executes the control logic 65 to process the lighting request 170 and generate the lighting request 220 that is sent only to the light fixture 30(4). In response, light fixture 30(4) generates and sends a response (not shown in FIG. 2D) that is sent back to the computing device 120 via the same path (i.e., switch 15 and light fixture 30(1)). The response that is forwarded from light fixture 30(4) to computing device 120 via the switch 15 and light fixture 30(1) may be the same lighting request throughout or processed/modified at each hop.

FIGS. 2A-2D illustrate several examples in which lighting attributes may be queried or controlled at a computing device using a wireless connection with a local light fixture. It is to be appreciated that these examples may be extended to enable management of multiple connections through a local light fixture. For example, one light fixture may have multiple wireless devices connected via, for example, Li-Fi. In such examples, the light fixture, switch, etc. are enable all connected wireless devices to connect to the light fixture (e.g., using different channels) to support the control and identification of lighting attributes. Additionally, the lighting management techniques presented herein enable the light fixture, switch, etc. to query attributes of wireless devices, such as power usage, etc. The lighting management techniques may also support query on, for example, received signal strength indicator (RSSI) or other measure of the wireless connections, Wi-Fi energy consumption, other wireless related energy attributes, etc. The lighting management system 70 can be saved from the communication overhead and the switch 15 could handle all the queries that are needed.

In addition to the query/control mechanisms described above, the lighting management techniques may also support access control mechanisms that limit the ability of users to change the attributes of light fixtures. For example, shown in FIG. 3 is an access control list 240 that is used to manage user information and authorization. The access control list 240 can be implemented as, for example, hash table that is stored at a light fixture, such as light fixture 30(1). As shown in FIG. 3, the access control list 240 includes a list 242 of users authorized to control attributes of the associated light fixture 30(1) as well as an indication 244 of the attributes that each user can control.

The indication 244 of the attributes that each user can control may be an actual list of the controllable attributes. In other examples, the indication 244 of the attributes that each user can control may be a level or type/class control designation that corresponds to the lighting attributes that the user can control. For example, members of the building management team may be associated with a level of control (e.g., level one) that enables them to change all lighting attributes for all light fixtures. A typical employee may be associated with a level of control (e.g., level five) that enables him/her to change only minimal settings within or close to his/her workspace (e.g., turn limited number of light fixtures on/off, dim a limited number of light fixtures, etc.).

In certain examples, an access control list may change dynamically. For example, if user "A" and user "B" reserve a conference room between 1-3 PM, then both user A and user B could be dynamically added to the access control lists of the light fixtures in the conference room for the period between approximately 1 and 3 PM, thereby enabling both users control over the light fixtures in the conference during the meeting. After 3 PM, users A and B could be removed from the access control list of the light fixtures in that conference room unless requested otherwise.

The access control list mechanism may be combined with the query/control mechanism described above. For example, a user wishing to query all or some of the light fixtures in a conference room may use a computing device to send queries to the selected light fixtures. However, responses may only be generated by light fixtures in which the user is identified in the associated access control list has having the authority to query the light fixture to modify or obtain the attributes of the light fixture.

Along with the access control mechanism, the lighting management techniques presented herein are configured to support consensus-based user control of light fixtures. In accordance with one consensus-based user control example, a period of time for users to input their choices for lighting attributes of selected light fixtures may be defined. During this period, users send lighting requests to the switch 15, lighting management system 70, or other central entity that identifies the associated user's selected lighting attributes for the selected light fixtures. The central entity holds the lighting requests and, after the consensus period is timed out, the central entity calculates, based on all valid inputs (i.e., lighting requests received from authorized users), light control settings for the light fixtures. The central entity may then generate a new lighting request that is sent to the light fixtures that causes the light fixtures to take the appropriate action.

As noted, in the consensus-based user control of light fixtures, multiple lighting requests may be received and some may be in conflict with one another (e.g., some messages request to change the light fixtures to a "warmer" white light color, while other messages request to change the light fixtures to a "cooler" white light color). As such, the lighting management techniques presented herein include conflict resolution capabilities that may be used to resolve conflicts in received lighting requests. For example, users A and B may both request to change the brightness of the same light. If the timing difference between when the requests are received is below a selected or predefined time interval, then a conflict resolution mechanism may be triggered.

In one example, if both users A and B request a change, the switch could take the (weighted) average of the inputs of A and B (e.g., the decision policy can be defined by the management team such that, for example, the users with more power can have more weight when calculating the average). In other examples, the switch could reject the conflicted requests, and notify both users A and B with the rejection information of both users.

The lighting management techniques presented herein may also support management override of lighting attributes. For example, an authorized user may send lighting requests to set the attributes of a light fixture, but the lighting request includes light control settings that, for example, violate the building code or the rules set by the management team. As such, the central entity or a light fixture may be configured to reject the lighting request. The central entity or a light fixture may also send a rejection report to the user or to the management team for further review. In certain examples, the lighting request submitted by the authorized user may be held and forwarded.

Figure 4:
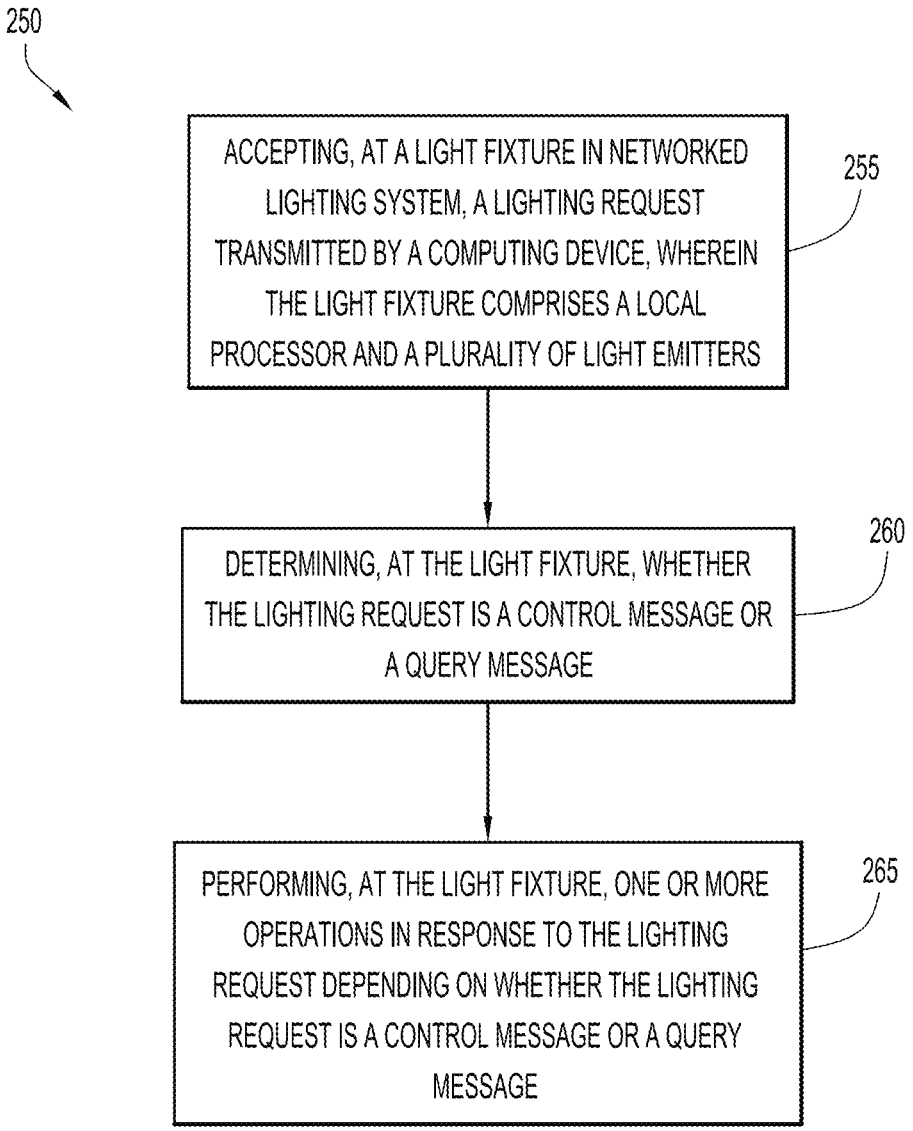
FIG. 4 is a flowchart of a method in accordance with embodiments presented herein.

FIG. 4 is a flowchart of a method 250 in accordance with examples presented herein. Method 250 begins at 255 where a light fixture in a networked lighting system accepts a lighting request transmitted by a computing device. The light fixture comprises a local processor and a plurality of light emitters. At 260, the light fixture determines whether the lighting request is a control message or a query message. At 265, the light fixture performs one or more operations in response to the lighting request depending on whether the lighting request is a control message or a query message.

Presented herein are lighting management techniques supporting lighting functions of networked light fixtures. The lighting management techniques provide active control loops for the settings of individual light fixtures to, for example, improve energy efficiency. The lighting management techniques also provide intelligence to lighting in a space and enable enforcement of building management codes, such as exit and emergency lighting, and minimum light illumination levels. The lighting management techniques may also enable the use of dynamic lighting policies (e.g., policies that change upon time and season) and provide the ability to resolve conflicts between different lighting requests from multiple users.

To summarize, in one form, a method is provided comprising: accepting, at a light fixture in networked lighting system, a lighting request, wherein the light fixture comprises a local processor and a plurality of light emitters; determining, at the light fixture, whether the lighting request is a control message or a query message; and performing, at the light fixture, one or more operations in response to the lighting request depending on whether the lighting request is a control message or a query message.

In another form, an apparatus, comprising: one or more network interface devices; a plurality of light emitters; a memory; and a processor that: accepts a lighting request, determines whether the lighting request is a control message or a query message, and performs one or more operations in response to the lighting request depending on whether the lighting request is a control message or a query message.

In still another form, one or more computer readable storage media are provided encoded with software comprising computer executable instructions and when the software is executed operable to: accept, at a light fixture in networked lighting system, a lighting request, wherein the light fixture comprises a local processor and a plurality of light emitters; determine, at the light fixture, whether the lighting request is a control message or a query message; and perform, at the light fixture, one or more operations in response to the lighting request depending on whether the lighting request is a control message or a query message.

Although the techniques are illustrated and described herein as embodied in one or more specific examples, it is nevertheless not intended to be limited to the details shown, since various modifications and structural changes may be made within the scope and range of fixtures

What is claimed is:

1. A method comprising:

receiving a lighting request at a light fixture in a networked lighting system, wherein the light fixture comprises a local processor and a plurality of light emitters;

extracting one or more light control settings from the lighting request; and adjusting lighting attributes of one or more of the plurality of light emitters based on the one or more light control settings.

2. The method of claim 1, wherein the lighting request is received from a device connected to the networked lighting system via a wireless connection with at least one light fixture in the networked lighting system.

3. The method of claim 2, wherein the wireless connection is a light communication connection.

4. The method of claim 1, wherein receiving the lighting request comprises:

wirelessly receiving, at the light fixture, the lighting request directly from a computing device.

5. The method of claim 4, wherein the lighting request is a first lighting request that is transparent to the light fixture, and wherein the method further comprises forwarding the first lighting request to a switch; and receiving a second lighting request from the switch, wherein the second lighting request is configured to cause the light fixture to perform one or more operations.

6. The method of claim 1, wherein a computing device sends, via a network connection, the lighting request to a lighting management system of the networked lighting system, and wherein receiving the lighting request comprises:

receiving the lighting request from the lighting management system via the networked lighting system.

7. The method of claim 1, wherein the light fixture is a remote light fixture, and wherein the method further comprises:

wirelessly receiving, at a local light fixture, a first lighting request directly from a computing device, wherein the first lighting request is transparent to the local light fixture;

forwarding the first lighting request to a switch; and receiving, at the remote light fixture, a second lighting request from the switch, wherein the second lighting request is configured to cause the remote light fixture to perform one or more operations.

8. A method comprising:

receiving a lighting request at a light fixture in a networked lighting system, wherein the light fixture comprises a local processor and a plurality of light emitters;

identifying, from the lighting request, one or more requested lighting attributes;

generating a query response that includes the requested lighting attributes; and sending the query response to a computing device.

9. The method of claim 1, wherein the lighting request is received from a device connected to the networked lighting system via a wireless connection with at least one light fixture in the networked lighting system.

10. The method of claim 9, wherein the wireless connection is a light communication connection.

11. The method of claim 8, wherein receiving the lighting request comprises:

wirelessly receiving, at the light fixture, the lighting request directly from a computing device.

12. The method of claim 11, wherein the lighting request is a first lighting request that is transparent to the light fixture, and wherein the method further comprises:

forwarding the first lighting request to a switch; and receiving a second lighting request from the switch, wherein the second lighting request is configured to cause the light fixture to perform one or more operations.

13. The method of claim 8, wherein a computing device sends, via a network connection, the lighting request to a lighting management system of the networked lighting system, and wherein receiving the lighting request comprises:

receiving the lighting request from the lighting management system via the networked lighting system.

14. The method of claim 8, wherein the light fixture is a remote light fixture, and wherein the method further comprises:

wirelessly receiving, at a local light fixture, a first lighting request directly from a computing device, wherein the first lighting request is transparent to the local light fixture;

forwarding the first lighting request to a switch; and receiving, at the remote light fixture, a second lighting request from the switch, wherein the second lighting request is configured to cause the remote light fixture to perform one or more operations.

15. An apparatus comprising:

one or more network interface devices;

a plurality of light emitters a memory; and a processor configured to:

receive a lighting request, extract one or more light control settings from the lighting request, and adjust lighting attributes of one or more of the plurality of light emitters based on the one or more light control settings.

16. The apparatus of claim 15, wherein the apparatus is part of a networking lighting system, and wherein the lighting request is received from a device connected to the networked lighting system via a wireless connection with at least one light fixture in the networked lighting system.

17. The apparatus of claim 16, wherein the wireless connection is a light communication connection.

18. The apparatus of claim 15, wherein at least one of the one or more network interface devices wirelessly receives the lighting request directly from a computing device.

19. The apparatus of claim 18, wherein the lighting request is a first lighting request that is transparent to the apparatus, and wherein the processor is configured to:

forward the first lighting request to a switch; and receive a second lighting request from the switch, wherein the second lighting request is configured to cause the apparatus to perform one or more operations in response to the second lighting request.

20. The apparatus of claim 18, wherein the apparatus is a local light fixture, and wherein the lighting request is transparent to the local light fixture such that processor is configured to forward the first lighting request to a remote light fixture via a switch.

* * * * *